US011217147B2

(12) United States Patent
Liu

(10) Patent No.: US 11,217,147 B2
(45) Date of Patent: Jan. 4, 2022

(54) DISPLAY DEVICE AND LIGHT-EMITTING CONTROL CIRCUIT THEREOF, DRIVING METHOD

(71) Applicant: BOE Technology Group Co., Ltd., Beijing (CN)

(72) Inventor: Libin Liu, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/772,851

(22) PCT Filed: Dec. 26, 2019

(86) PCT No.: PCT/CN2019/128878
§ 371 (c)(1),
(2) Date: Jun. 15, 2020

(87) PCT Pub. No.: WO2020/155975
PCT Pub. Date: Aug. 6, 2020

(65) Prior Publication Data

US 2021/0217348 A1 Jul. 15, 2021

(30) Foreign Application Priority Data

Jan. 30, 2019 (CN) ..... 201910091078.1

(51) Int. Cl.
*G09G 3/20* (2006.01)
*G09G 3/3283* (2016.01)

(52) U.S. Cl.
CPC ..... *G09G 3/2074* (2013.01); *G09G 3/3283* (2013.01); *G09G 2300/0452* (2013.01); *G09G 2300/0876* (2013.01)

(58) Field of Classification Search
CPC ..... G09G 3/30–3291
See application file for complete search history.

(56) References Cited

U.S. PATENT DOCUMENTS

2007/0103416 A1* 5/2007 Kim ..... G09G 3/3611 345/88
2007/0126671 A1 6/2007 Komiya et al.
(Continued)

FOREIGN PATENT DOCUMENTS

CN 1975846 A 6/2007
CN 102110410 A 6/2011
(Continued)

OTHER PUBLICATIONS

International search report of PCT application No. PCT/CN2019/128878 dated Mar. 24, 2020.
(Continued)

*Primary Examiner* — Hang Lin
(74) *Attorney, Agent, or Firm* — Fay Sharpe LLP

(57) ABSTRACT

A light-emitting control circuit and a driving method of a display device are disclosed. The display device includes a plurality of rows of sub-pixels; each row of sub-pixels includes at least first color sub-pixels and second color sub-pixels; each of the first and second color sub-pixels includes a pixel circuit and a light-emitting unit; the light-emitting control circuit includes a plurality of light-emitting control circuit groups which are in a one-to-one correspondence with the plurality of rows of sub-pixels; each of the plurality of light-emitting control circuit groups at least includes a first light-emitting control sub-circuit and a second light-emitting control sub-circuit; the first and second light-emitting control sub-circuit provide a first light-emitting control signal and a second light-emitting control signal, respectively; and each of the first and second light-emitting control signal is used for driving the pixel circuit to output a driving current to the light-emitting unit.

20 Claims, 4 Drawing Sheets

(56) References Cited

U.S. PATENT DOCUMENTS

| | | | | |
|---|---|---|---|---|
| 2011/0157250 | A1* | 6/2011 | Hasegawa | G09G 3/3283 345/690 |
| 2014/0225939 | A1 | 8/2014 | Hasegawa | |
| 2014/0354520 | A1 | 12/2014 | Sato et al. | |
| 2016/0035276 | A1 | 2/2016 | Yin et al. | |

FOREIGN PATENT DOCUMENTS

| | | | |
|---|---|---|---|
| CN | 103700342 | A | 4/2014 |
| CN | 105551433 | A | 5/2016 |
| CN | 106847189 | A | 6/2017 |
| CN | 109616039 | A | 4/2019 |

OTHER PUBLICATIONS

First office action of Chinese application No. 201910091078.1 dated Mar. 19, 2020.

* cited by examiner

DISPLAY DEVICE AND LIGHT-EMITTING CONTROL CIRCUIT THEREOF, DRIVING METHOD

This application is a 371 of PCT Application No. PCT/CN2019/128878, filed Dec. 26, 2019, which claims priority to Chinese Patent Application No. 201910091078.1, filed on Jan. 30, 2019 and entitled "DISPLAY PANEL, LIGHT-EMITTING CONTROL CIRCUIT OF DISPLAY PANEL, DRIVING METHOD AND DISPLAY DEVICE", the entire contents of which are incorporated herein by reference.

TECHNICAL FIELD

Embodiments of the present disclosure relate to a display device and a light-emitting control circuit thereof, and a driving method.

BACKGROUND

A display panel includes a plurality of pixels arranged in an array, each pixel may include a plurality of sub-pixels of different colors, and each sub-pixel includes a pixel circuit and a light-emitting unit. The display panel is generally further provided with a light-emitting control circuit connected to a light-emitting control terminal of the pixel circuit in each sub-pixel. The light-emitting control circuit may output a light-emitting control signal to the light-emitting control terminal of the pixel circuit, and the pixel circuit may output a driving current to the light-emitting unit under the control of the light-emitting control signal, so as to drive the light-emitting unit to emit light with a predetermined brightness. Here, the greater the duty ratio of the light-emitting control signal is, the longer the light-emitting time of the light-emitting unit driven by the pixel circuit is, and the higher the brightness of the light-emitting unit is.

In related arts, a plurality of light-emitting control circuits is generally arranged in the display panel, and each light-emitting control circuit is connected to a pixel circuit of each sub-pixel in one row of sub-pixels. The plurality of light-emitting control circuits may drive a plurality of rows of sub-pixels to emit light row by row. Due to different light-emitting efficiencies of the light-emitting units in the sub-pixels of different colors, when the same brightness is displayed, a driving current required by a light-emitting unit with a lower light-emitting efficiency is larger, and a driving current required by a light-emitting unit with a higher light-emitting efficiency is smaller.

However, compared with other light-emitting units, the light-emitting unit with lower light-emitting efficiency is shorter in service life as it requires the larger driving current. As the light-emitting unit with higher light-emitting efficiency requires smaller driving current when displaying low brightness, a threshold voltage drift of a driving transistor in the pixel circuit connected to the light-emitting unit has a greater influence on the light-emitting unit, resulting in a larger brightness deviation of the light-emitting unit.

SUMMARY

At least one embodiment of the present disclosure provides a light-emitting control circuit of a display panel. The display panel includes a plurality of rows of sub-pixels, each row of sub-pixels in the plurality of rows of sub-pixels includes at least first color sub-pixels and second color sub-pixels, and each of the first color sub-pixels and the second color sub-pixels includes a pixel circuit and a light-emitting unit;

the light-emitting control circuit includes a plurality of light-emitting control circuit groups which are in a one-to-one correspondence with the plurality of rows of sub-pixels, each of the plurality of light-emitting control circuit groups at least includes a first light-emitting control sub-circuit and a second light-emitting control sub-circuit; and the first light-emitting control sub-circuit and the second light-emitting control sub-circuit are connected to the pixel circuits of the first color sub-pixels and the pixel circuits of the second color sub-pixels in one row of sub-pixels, respectively, and provide a first light-emitting control signal and a second light-emitting control signal respectively, and each of the first light-emitting control signal and the second light-emitting control signal is used for driving the pixel circuit to output a driving current to the light-emitting unit.

In some embodiments of the present disclosure, the first light-emitting control signal and the second light-emitting control signal have different duty ratios.

In some embodiments of the present disclosure, the first color sub-pixels are blue sub-pixels, and the second color sub-pixels are green sub-pixels.

In some embodiments of the present disclosure, the first light-emitting control signal and the second light-emitting control signal are pulse width modulation PWM signals; and the duty ratio of the first light-emitting control signal is greater than the duty ratio of the second light-emitting control signal.

In some embodiments of the present disclosure, the duty ratio of the first light-emitting control signal is two thirds; and the duty ratio of the second light-emitting control signal is one third.

In some embodiments of the present disclosure, each row of sub-pixels in the plurality of rows of sub-pixels further includes red sub-pixels; and pixel circuits of the red sub-pixels are connected to the first or second light-emitting control sub-circuit.

In some embodiments of the present disclosure, each row of sub-pixels in the plurality of rows of sub-pixels further includes red sub-pixels; each of the plurality of light-emitting control circuit groups further includes a third light-emitting control sub-circuit; and the red sub-pixels are connected to the third light-emitting control sub-circuit.

At least one embodiment of the present disclosure provides a display panel. The display panel includes: a plurality of sub-pixels arranged in an array, and the aforesaid light-emitting control circuit, wherein the light-emitting control circuit is connected to a pixel circuit of each sub-pixel in each row of sub-pixels.

In some embodiments of the present disclosure, the display panel further includes: a source driver circuit, wherein the source driver circuit is connected to a pixel circuit of each sub-pixel in each column of sub-pixels, and is used for providing data signals for the pixel circuits in each column of sub-pixels; and the pixel circuit is used to adjust a magnitude of a driving current output to the light-emitting unit according to the data signal.

At least one embodiment of the present disclosure provides a driving method of a display panel, wherein the driving method is suitable for the aforesaid display panel. The method includes:

outputting compensated data signals by a source driver circuit to a pixel circuit of first color sub-pixels and a pixel circuit of second color sub-pixels in each column of sub-pixels; and outputting a light-emitting control signal by each light-emitting control sub-circuit in each of light-emitting control circuit groups to a pixel circuit of at least one color sub-pixel connected to the light-emitting control sub-circuit.

In some embodiments of the present disclosure, the data signal is used for controlling a magnitude of a driving current output by the pixel circuit; and the light-emitting control signal is used for controlling a light-emitting time of a light-emitting unit in the sub-pixel.

In some embodiments of the present disclosure, duty ratios of light-emitting control signals output by any two of the light-emitting control sub-circuits in each of the plurality of light-emitting control circuit groups are different; and the duty ratio of the light-emitting control signal is negatively related to a light-emitting efficiency of the light-emitting unit.

In some embodiments of the present disclosure, the voltage of the compensated data signal output by the source driver circuit to the pixel circuit in the first color sub-pixels are lower than a voltage of a data signal before the compensation; and the voltage of the compensated data signal output by the source driver circuit to the pixel circuit in the second color sub-pixels are higher than a voltage of a data signal before the compensation.

In some embodiments of the present disclosure, a duty ratio of a first light-emitting control signal output by the first light-emitting control sub-circuit to the pixel circuit of the first color sub-pixels are greater than a first threshold; a duty ratio of a second light-emitting control signal output by the second light-emitting control sub-circuit to the pixel circuit of the second color sub-pixels are less than a second threshold; and the first threshold is greater than or equal to the second threshold.

At least one embodiment of the present disclosure further provides a display device. The display device includes the aforesaid display panel.

BRIEF DESCRIPTION OF THE DRAWINGS

In order to describe the technical solutions in the embodiments of the present disclosure more clearly, the following briefly introduces accompanying drawings required for describing the embodiments. Apparently, accompanying drawings in the following description show merely some embodiments of the present disclosure, and a person of ordinary skill in the art may also derive other drawings from these accompanying drawings without creative efforts.

DETAILED DESCRIPTION

For clearer descriptions of the objects, technical solutions and advantages in the present disclosure, the implementations of the present disclosure are described in detail below in combination with accompanying drawings.

At least one embodiment of the present disclosure provides a light-emitting control circuit of a display panel. The display panel includes a plurality of rows of sub-pixels, and each row of sub-pixels in the plurality of rows of sub-pixels includes at least first color sub-pixels and second color sub-pixels, each of the first color sub-pixels and the second color sub-pixels includes a pixel circuit and a light-emitting unit. The light-emitting control circuit includes a plurality of light-emitting control circuit groups which are in a one-to-one correspondence with the plurality of rows of sub-pixels. Each of the plurality of light-emitting control circuit groups at least includes a first light-emitting control sub-circuit and a second light-emitting control sub-circuit. The first light-emitting control sub-circuit and the second light-emitting control sub-circuit are connected to the pixel circuits of the first and second color sub-pixels in one row of sub-pixels, respectively, and provide a first light-emitting control signal and a second light-emitting control signal, respectively. Each of the first light-emitting control signal and the second light-emitting control signal is used for driving the pixel circuit to output a driving current to the light-emitting unit.

Figure 1:
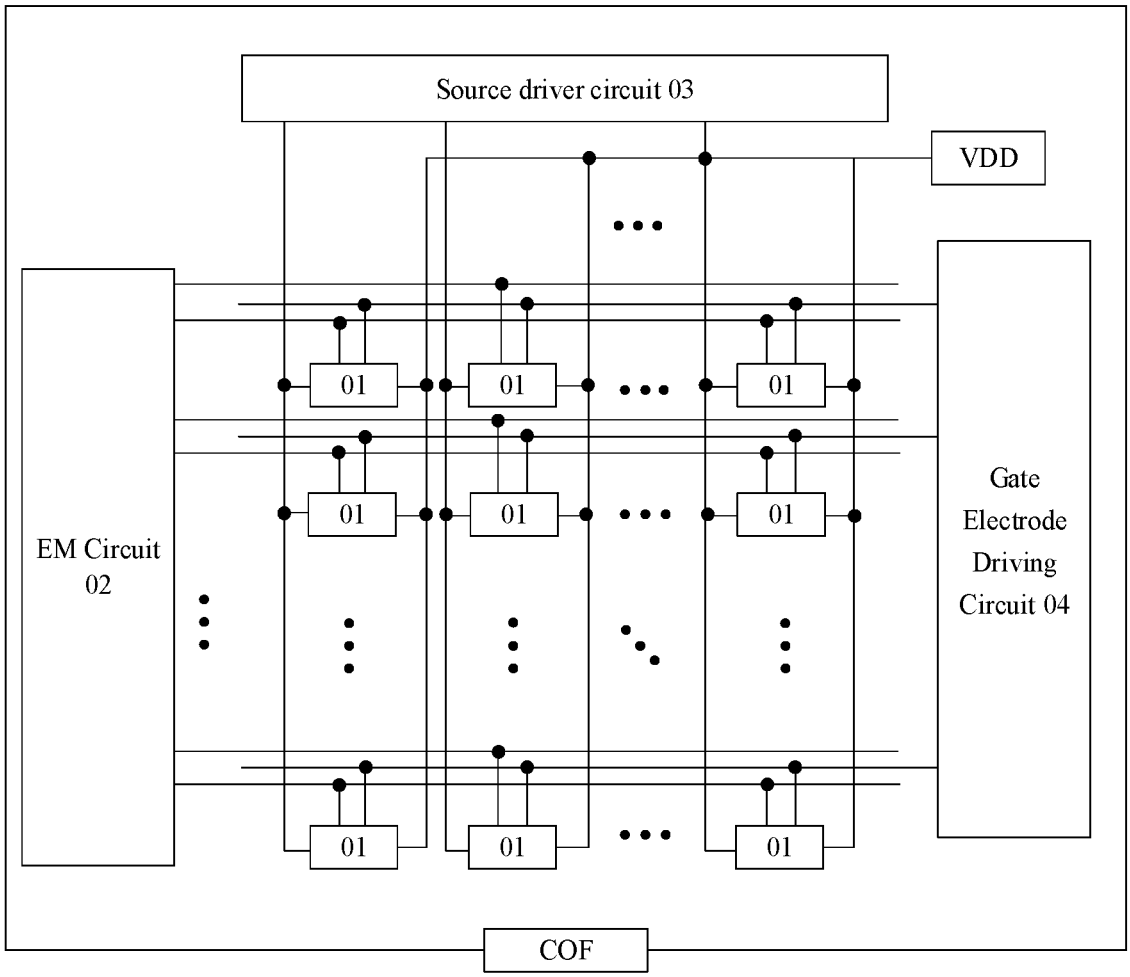
FIG. 1 is a schematic structure diagram of a display panel according to an embodiment of the present disclosure.

FIG. 1 is a schematic structure diagram of a display panel according to an embodiment of the present disclosure. Referring to FIG. 1, it can be seen that the display panel may include a plurality of sub-pixels 01 arranged in an array, a light-emitting control circuit 02, a source driver circuit 03 and a Gate driver circuit 04. The plurality of sub-pixels 01 is located in a displaying area of the display panel; and the light-emitting control circuit 02, the source driver circuit 03 and the Gate driver circuit 04 are all located in a peripheral area around the displaying area. The light-emitting control circuit 02 may also be referred to as an emission (EM) circuit. The source driver circuit 03 may be an integrated circuit (IC). The Gate driver circuit 04 may be a gate electrode driver on array (GOA) circuit. A chip on film (COF) may also be arranged on a side surface of the display panel, refers to a chip on soft film package technology that the light-emitting control circuit 02, the source driver circuit 03 and the Gate driver circuit 04 are fixed onto a flexible circuit board, and refers to a technology that uses a soft additional circuit board as a carrier for packaging the chip so as to join the chip to the flexible substrate circuit.

Figure 2:
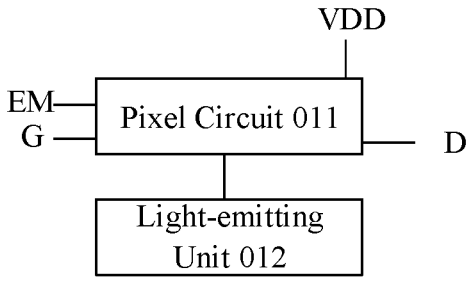
FIG. 2 is a schematic structure diagram of a sub-pixel according to an embodiment of the present disclosure.

FIG. 2 is a schematic structure diagram of a sub-pixel according to an embodiment of the present disclosure. Referring to FIG. 2, each sub-pixel 01 may include a pixel circuit 011 and a light-emitting unit 012 which may be an organic light-emitting diode (OLED).

In conjunction with FIGS. 1 and 2, it can be seen that the light-emitting control circuit 02 may be connected to a light-emitting control terminal EM of the pixel circuit of each sub-pixel in each row of sub-pixels, and is used for providing a light-emitting control signal for the light-emitting control terminal EM. The Gate driver circuit 04 may be connected to a gate electrode signal terminal G of the pixel circuit of each sub-pixel in each row of sub-pixels, and is used for providing a gate electrode driving signal for the gate electrode signal terminal G. The source driver circuit 03 may be connected to a data signal terminal D of the pixel circuit of each sub-pixel in each column of sub-pixels, and is used for providing a data signal for the data signal terminal D. In this display panel, the pixel circuit of each sub-pixel may further be connected to a power supply signal terminal VDD.

Each pixel circuit 011 can store a data voltage of the data signal under the driving of the gate electrode driving signal. In addition, each pixel circuit 011 can output a driving current to the light-emitting unit 012 under the power supply by the power supply signal terminal VDD when a received light-emitting control signal is at an active level; and a magnitude of the driving current is positively related to a magnitude of the stored data voltage.

The plurality of sub-pixels 01 in the display panel generally includes: red sub-pixels, a green sub-pixel and a blue sub-pixel, wherein a light-emitting unit of the blue sub-pixel has a lower light-emitting efficiency; a light-emitting unit of the green sub-pixel has a higher light-emitting efficiency; and a light-emitting efficiency of a light-emitting unit in the red sub-pixels are greater than the light-emitting efficiency of the light-emitting unit in the blue sub-pixel, and is less than the light-emitting efficiency of the light-emitting unit in the green sub-pixel.

Therefore, in related arts, in order to ensure the uniformity of displayed brightness, when the same brightness is displayed, a driving current IB output by the pixel circuit to the light-emitting unit in the blue sub-pixel is larger, a driving current IG output by the pixel circuit to the light-emitting unit in the green sub-pixel is smaller, and a driving current IR output by the pixel circuit to the light-emitting unit in the red sub-pixels are greater than the driving current IB output by the pixel circuit to the light-emitting unit in the blue sub-pixel, and is smaller than the driving current IG output by the pixel circuit to the light-emitting unit in the green sub-pixel, i.e., IG<IR<IB.

The service life of the light-emitting unit is negatively related to the driving current, that is, the larger the driving current is, the shorter the service life is; and the smaller the driving current is, the longer the service life is. Therefore, driving methods in the related arts will shorten the service life of the blue sub-pixel. Moreover, as the light-emitting unit in the green sub-pixel has a higher light-emitting efficiency, when displaying the same brightness, it requires a smaller driving current. Thus, when the lower brightness is displayed, the required driving current will be further reduced, so that a voltage of the data signal that the source driver circuit needs to output to the pixel circuit of the green sub-pixel is also smaller, and may exceed an adjustment range of the voltage of the data signal output by the source driver circuit, resulting in failure to provide the pixel circuit with the required voltage. In addition, when the driving current output by the pixel circuit to the light-emitting unit in the green sub-pixel is smaller, a threshold voltage drift of a driving transistor in the pixel circuit has a greater influence on the driving current, resulting in a larger brightness deviation of the light-emitting unit, and adversely affecting the brightness uniformity of the display panel. Further, as a human eye is most sensitive to light emitted by the green sub-pixel, when the brightness of the light-emitting unit in the green sub-pixel is deviated, the brightness uniformity of the display panel observed by the human eye is worse (namely, a phenomenon of mura).

Figure 3:
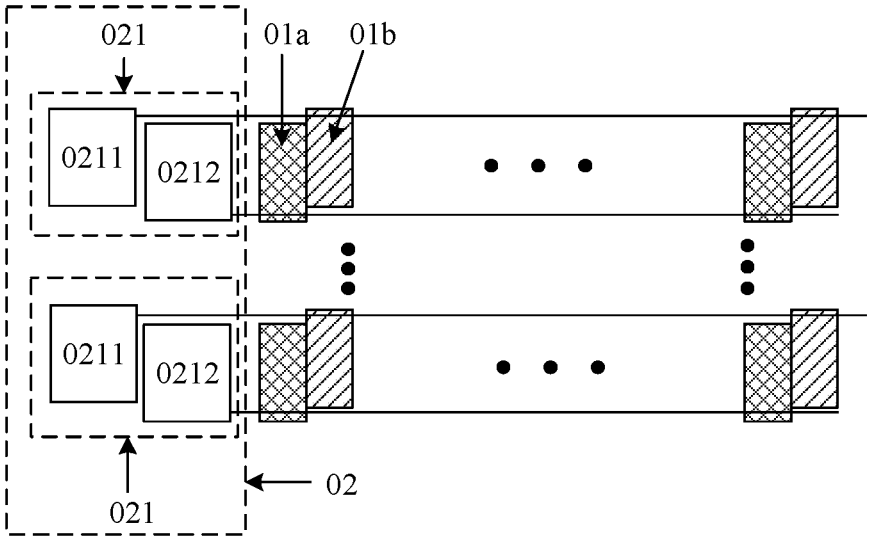
FIG. 3 is a schematic structure diagram of a light-emitting control circuit according to an embodiment of the present disclosure.

FIG. 3 is a schematic structure diagram of a light-emitting control circuit provided by an embodiment of the present disclosure. The light-emitting control circuit can solve problems in the related art that the service life of the light-emitting unit with the lower light-emitting efficiency is shorter and the brightness deviation of the light-emitting unit with the higher light-emitting efficiency is larger. The light-emitting control circuit may be applied to the display panel shown in FIG. 1. Referring to FIG. 3, it can be seen that the display panel may include a plurality of rows of sub-pixels, and each row of sub-pixels may include a plurality of sub-pixels of different colors. In FIG. 3, different fill patterns represent sub-pixels of different colors. For example, in the structure shown in FIG. 3, each row of sub-pixels may include first color sub-pixels 01*a* and second color sub-pixels 01*b*. Referring to FIG. 2, each sub-pixel may include a pixel circuit 011 and a light-emitting unit 012.

Referring to FIG. 3, the light-emitting control circuit 02 may include: a plurality of light-emitting control circuit groups 021. Each of the light-emitting control circuit groups 021 corresponds to one row of sub-pixels, and includes at least two light-emitting control sub-circuits. Each light-emitting control sub-circuit may be connected to a light-emitting control signal terminal of a pixel circuit of at least one color sub-pixel in one row of sub-pixels, and provides a light-emitting control signal used for driving the pixel circuit to output a driving current to the light-emitting unit.

At least two light-emitting control sub-circuits in each light-emitting control circuit group 021 may be connected to the same row of sub-pixels, and colors of sub-pixels connected to any two light-emitting control sub-circuits are different.

For example, as shown in FIG. 3, each light-emitting control circuit group 021 may include two light-emitting control sub-circuits 0211 and 0212. In the display panel, each row of sub-pixels includes two color sub-pixels, namely, the first color sub-pixels 01*a* and the second color sub-pixels 01*b*. A light-emitting control sub-circuit 0211 in the light-emitting control circuit group 021 may be connected to the first color sub-pixels 01*a*; and a light-emitting control sub-circuit 0212 in the light-emitting control circuit group 021 may be connected to the second color sub-pixels 01*b*.

Figure 4:
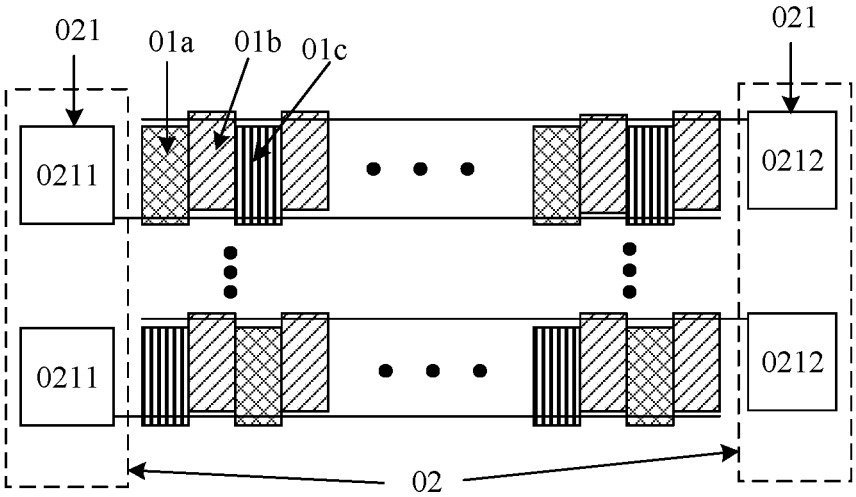
FIG. 4 is a schematic structure diagram of a light-emitting control circuit according to another embodiment of the present disclosure.

For example, as shown in FIG. 4, in the display panel, each row of sub-pixels includes three color sub-pixels, namely, a third color sub-pixel 01*c* except for the first color sub-pixels 01*a* and the second color sub-pixels 01*b* shown in FIG. 3. The light-emitting control sub-circuit 0211 in the light-emitting control circuit group 021 may be connected to the first color sub-pixels 01*a* and the third color sub-pixel 01*c* in one row of sub-pixels; and the light-emitting control sub-circuit 0212 in the light-emitting control circuit group 021 may be connected to the second color sub-pixels 01*b* in one row of sub-pixels.

In an embodiment of the present disclosure, at least two light-emitting control sub-circuits in the light-emitting control circuit group 021 send light-emitting control signals having different duty ratios. The light-emitting control sub-circuits 0211 and 0212 are connected to sub-pixels of different colors, respectively. For example, the light-emitting control sub-circuit 0211 is connected to the first color sub-pixels 01*a*, and the light-emitting control sub-circuit 0212 is connected to the second color sub-pixels 01*b*. If the light-emitting efficiency of the light-emitting unit of the first color sub-pixels 01*a* is lower (for example, the first color is blue), in a displaying process of one frame of image, the light-emitting control sub-circuit 0211 outputs a light-emitting control signal with a large duty ratio to the first color sub-pixels 01*a*, lengthening a light-emitting time of the first color sub-pixels 01*a*. Compared with a light-emitting time without lengthening the light-emitting time of the first color sub-pixels 01*a*, in order to achieve the same light-emitting brightness, a driving current provided to the first color sub-pixels 01*a* needs to be reduced, so as to prolong the service life of the first color sub-pixels 01*a*. If the light-emitting efficiency of the second color sub-pixels 01*b* is higher (for example, the second color is green), in a displaying process of one frame of image, the light-emitting control sub-circuit 0212 outputs a light-emitting control signal with a small duty ratio to the second color sub-pixels 01*b*, shortening a light-emitting time of the second color sub-pixels 01*b*. Compared with not shortening the light-emitting time of the second color sub-pixels 01*b*, in order to achieve the same light-emitting brightness, a driving current provided to the second color sub-pixels 01*b* needs to be increased. Thus, in the case of not shortening the light-emitting time of the second color sub-pixels 01*b*, when the second color sub-pixels 01*b* displays a low brightness, a driving current output to the light-emitting unit of the second color sub-pixels 01*b* can be increased, so that the influence of a threshold voltage drift of a driving transistor in the pixel circuit on the driving current is reduced, thereby ensuring the brightness uniformity of the display panel and improving the image quality of the display panel.

As the light-emitting control circuit provided by the embodiment of the present disclosure includes the plurality of light-emitting control circuit groups 021 which corresponds to one row of sub-pixels. Each light-emitting control circuit group 021 may include at least two light-emitting control sub-circuits. The at least two light-emitting control sub-circuits included in each light-emitting control circuit group 021 may be connected to the same row of sub-pixels, and colors of sub-pixels connected to any two light-emitting control sub-circuits are different. Therefore, according to the light-emitting efficiency of the light-emitting unit in each sub-pixel, duty ratios of the light-emitting control signals output by the light-emitting control sub-circuits to the pixel circuits in the sub-pixels of different colors can be adjusted. That is, the light-emitting time of the light-emitting unit in each sub-pixel is adjusted in the displaying process of one frame of image. Further, the voltage of the data signal output by the source driver circuit to the pixel circuit in each sub-pixel can be adjusted according to the duty ratio of the light-emitting control signal. That is, the magnitude of the driving current output by the pixel circuit to the light-emitting unit in each sub-pixel can be adjusted.

In the embodiment of the present disclosure, for a light-emitting unit with a lower light-emitting efficiency in a sub-pixel of a color (for example, a blue sub-pixel), the light-emitting control sub-circuit can output a light-emitting control signal with a larger duty ratio to the sub-pixel of the color. That is, a light-emitting time of the light-emitting unit in the sub-pixel of the color in the displaying process of one frame of image is lengthened. Thus, a voltage of the data signal output by the source driver circuit to the pixel circuit in the sub-pixel of the color can be adjusted according to the duty ratio, so that a driving current output by the pixel circuit to the light-emitting unit in the sub-pixel of the color is reduced, thereby prolonging the service life of the sub-pixel of the color.

For a light-emitting unit with a higher light-emitting efficiency in a sub-pixel of a color (for example, a green sub-pixel), the light-emitting control sub-circuit can output a light-emitting control signal with a smaller duty ratio to the sub-pixel of the color. That is, a light-emitting time of the light-emitting unit in the sub-pixel of the color in the displaying process of one frame of image is shortened. Thus, a voltage of the data signal output by the source driver circuit to the pixel circuit in the sub-pixel of the color can be increased according to the duty ratio, so that it is ensured that the voltage does not exceed an adjustment range of the voltage of the data signal output by the source driver circuit. In addition, as the voltage of the data signal output by the source driver circuit to the pixel circuit in the sub-pixel of the color increases, the driving current output by the pixel circuit to the light-emitting unit in the sub-pixel of the color accordingly increases. Thus, the threshold voltage drift of the driving transistor in the pixel circuit has a less influence on the driving current, and the brightness deviation of the light-emitting unit is smaller. Therefore, the brightness uniformity of the display panel is ensured, improving the image quality of the display panel.

In summary, the embodiments of the present disclosure provide the light-emitting control circuit including the plurality of light-emitting control circuit groups; each light-emitting control circuit group includes the at least two light-emitting control sub-circuits; and the light-emitting control signals sent by the at least two light-emitting control sub-circuits have different duty ratios. The at least two light-emitting control circuits may be connected to the sub-pixels in the same row, and the colors of the sub-pixels connected to any two light-emitting control sub-circuits are different. Thus, the light-emitting control signals of different duty ratios are provided by the different light-emitting control sub-circuits for the sub-pixels of different colors, so that the light-emitting times of the light-emitting units in the sub-pixels of different colors can be adjusted in the displaying process of one frame of image. Therefore, in the case of achieving the same displaying brightness, a smaller driving current is provided for the light-emitting unit with a low light-emitting efficiency in the sub-pixel by adjusting the magnitudes of the voltages of the data signals output by the source driver circuit to the sub-pixels of different colors, so as to prolong the service life of the light-emitting unit. A larger driving current is provided for the light-emitting unit with a high light-emitting efficiency in the sub-pixel, reducing the influence of the threshold voltage drift on the brightness of the light-emitting unit with the higher light-emitting efficiency when displaying a low brightness.

Optionally, in the embodiments of the present disclosure, in each row of sub-pixels in the display panel, the first color sub-pixels 01*a* may be the blue sub-pixel, and the second color sub-pixels may be the green sub-pixel 01*b*.

In the at least two light-emitting control sub-circuits included in each light-emitting control circuit group 021, the first light-emitting control sub-circuit 0211 may be connected to a light-emitting control signal terminal of the pixel circuit of the blue sub-pixel 01*a* in one row of sub-pixels, and the second light-emitting control sub-circuit 0212 may be connected to a light-emitting control signal terminal of the pixel circuit of the green sub-pixel 01*b* in one row of sub-pixels.

Optionally, the light-emitting control signal output by each light-emitting control sub-circuit may be a pulse width modulation (PWM) signal; and the duty ratio of the light-emitting control signal output by the first light-emitting control sub-circuit 0211 may be greater than that of the light-emitting control signal output by the second light-emitting control sub-circuit 0212. The duty ratio refers to the ratio of the duration of the active level to the time of a cycle of the light-emitting control signal in one cycle of the light-emitting control signal. In the present disclosure, taking a high level as the active level for example, the duty ratio refers to the ratio of the duration of the high level to the time of the cycle of the light-emitting control signal. Of course, in the implementation of the present disclosure, in the light-emitting control signals sent by the light-emitting control sub-circuit, the active level may also be a low level. In this case, the duty ratio refers to the ratio of the duration of the low level to the time of the cycle of the light-emitting control signal. The light-emitting time of the light-emitting unit in the displaying process of one frame of image is positively related to the duty ratio of the light-emitting control signal. That is, the greater the duty ratio of the light-emitting control signal is, the longer the light-emitting time of the light-emitting unit in the displaying process of one frame of image is; and the less the duty ratio of the light-emitting control signal is, the shorter the light-emitting time of the light-emitting unit in the displaying process of one frame of image is.

Figure 5:
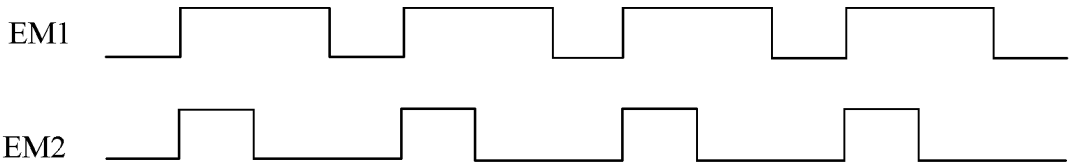
FIG. 5 is a timing diagram of a light-emitting control signal output by a light-emitting control sub-circuit according to an embodiment of the present disclosure.

FIG. 5 is a timing diagram of a light-emitting control signal output by a light-emitting control sub-circuit provided by an embodiment of the present disclosure. A light-emitting control signal output by the first light-emitting control sub-circuit 0211 is EM1, and a light-emitting control signal output by the second light-emitting control sub-circuit 0212 is EM2. In the timing diagram shown in FIG. 5, the low level is an active level. That is, when the light-emitting control signal received by the pixel circuit is at the low level, the pixel circuit can drive the light-emitting unit to emit light.

As shown in FIG. 5, frequencies of the first and second control signals EM1 and EM2 may be the same; and a duty ratio of the first control signal EM1 may be greater than that of the second control signal EM2. That is, in the displaying process of one frame of image, a light-emitting time of the light-emitting unit in the sub-pixel connected to the first light-emitting control sub-circuit 0211 may be longer than that of the light-emitting unit in the sub-pixel connected to the second light-emitting control sub-circuit 0212.

In the embodiment of the present disclosure, assuming that the brightness required to be displayed by the light-emitting unit in each sub-pixel is the target brightness, the driving current output by the pixel circuit to the light-emitting unit may be negatively related to the light-emitting time of the light-emitting unit in the displaying process of one frame of image. That is, when the brightness displayed by the light-emitting unit is unchanged, the longer the light-emitting time of the light-emitting unit in the displaying process of one frame of image is, the smaller the driving current output by the pixel circuit to the light-emitting unit can be; and the shorter the light-emitting time of the light-emitting unit in the displaying process of one frame of image is, the larger the driving current output by the pixel circuit to the light-emitting unit can be.

As the light-emitting unit in the blue sub-pixel 01*a* has a lower light-emitting efficiency, the first light-emitting control sub-circuit 0211 can output a light-emitting control signal with a larger duty ratio for the blue sub-pixel 01*a*, thereby lengthening the light-emitting time of the blue sub-pixel 01*a* in the displaying process of one frame of image. In the case of lengthening the light-emitting time of the blue sub-pixel 01*a* in the displaying process of one frame of image, the driving current output to the light-emitting unit of the blue sub-pixel 01*a* may be reduced while ensuring that the brightness of the blue sub-pixel 01*a* is the target brightness, so that the service life of the blue sub-pixel 01*a* can be prolonged.

As the light-emitting unit in the green sub-pixel 01*b* has a higher light-emitting efficiency, the second light-emitting control sub-circuit 0212 can output a light-emitting control signal with a smaller duty ratio for the green sub-pixel 01*b*, thereby shortening the light-emitting time of the green sub-pixel 01*b* in the displaying process of one frame of image. In the case of shortening the light-emitting time of the green sub-pixel 01*b* in the displaying process of one frame of image, the driving current output to the light-emitting unit of the green sub-pixel 01*b* may be increased while ensuring that the brightness of the green sub-pixel 01*b* is the target brightness, so that the influence of the threshold voltage drift of the driving transistor in the pixel circuit of the green sub-pixel 01*b* on the driving current is reduced, thereby reducing the brightness deviation of the light-emitting unit in the green sub-pixel 01*b*. Meanwhile, as the driving current output to the light-emitting unit of the green sub-pixel 01*b* is increased, the voltage of the data signal output by the source driver circuit to the pixel circuit in the green sub-pixel 01*b* can be appropriately increased accordingly. In the case of ensuring that the voltage does not exceed the adjustment range of the voltage of the data signal output by the source driver circuit, a requirement for adjustment accuracy of the data signal output by the source driver circuit is reduced.

As described above, the light-emitting control circuit provided by the embodiments of the present disclosure can balance a relationship between the service life of the blue sub-pixel and the brightness deviation of the light-emitting unit in the green sub-pixel. That is, not only can the service life of the blue sub-pixel be prolonged, but also the brightness deviation of the light-emitting unit in the green sub-pixel can be reduced.

Optionally, referring to FIG. 5, it can be seen that the time of each cycle of the light-emitting control signal may be one quarter of the total time of the displaying process of one frame of image. That is, in the displaying process of one frame of image, the light-emitting control signal can be repeated for four cycles.

As shown in FIG. 4, each row of sub-pixels may further include red sub-pixels 01*c*. A light-emitting control signal terminal of the pixel circuit of the red sub-pixels 01*c* in one row of sub-pixels may be connected to the first light-emitting control sub-circuit 0211. That is, the red sub-pixels 01*c* and the blue sub-pixel 01*a* may be connected to the same light-emitting control sub-circuit, namely the first light-emitting control sub-circuit 0211; and the green sub-pixel 01*b* is connected to the second light-emitting control sub-circuit 0212. At this time, the light-emitting control signals received by the red sub-pixels 01*c* and the blue sub-pixel 01*a* in each row of sub-pixels have the same duty ratio. That is, the light-emitting units in both the red sub-pixels 01*c* and the blue sub-pixel 01*a* have the same light-emitting time in the displaying process of one frame of image.

Figure 6:
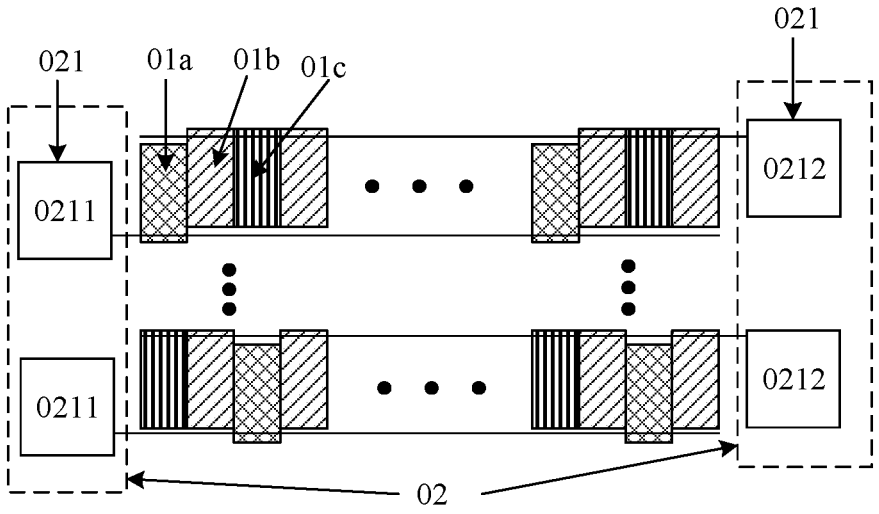
FIG. 6 is a schematic structure diagram of a light-emitting control circuit according to yet another embodiment of the present disclosure.

Optionally, as shown in FIG. 6, a light-emitting control signal terminal of the pixel circuit of the red sub-pixels 01*c* in one row of sub-pixels may be connected to the second light-emitting control sub-circuit 0212. That is, the red sub-pixels 01*c* and the green sub-pixel 01*b* may be connected to the same light-emitting control sub-circuit, namely the second light-emitting control sub-circuit 0212; and the blue sub-pixel 01*a* is connected to the first light-emitting control sub-circuit 0211. At this time, the light-emitting control signals received by the red sub-pixels 01*c* and the green sub-pixel 01*b* in each row of sub-pixels have the same duty ratio. That is, the light-emitting units in both the red sub-pixels 01*c* and the green sub-pixel 01*b* have the same light-emitting time in the displaying process of one frame of image.

Figure 7:
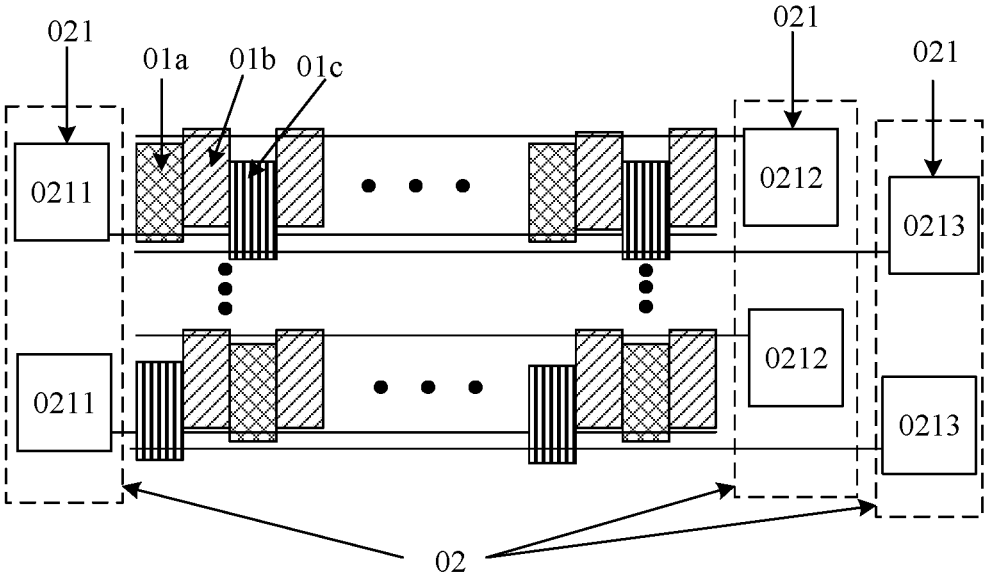
FIG. 7 is a schematic structure diagram of a light-emitting control circuit according to still another embodiment of the present disclosure.

Optionally, referring to FIG. 7, each light-emitting control circuit group 021 may further include a third light-emitting control sub-circuit 0213, and each row of sub-pixels may further include red sub-pixels 01*c*. The third light-emitting control sub-circuit 0213 may be connected to a light-emitting control signal terminal of the pixel circuit of the red sub-pixels 01*c* in one row of sub-pixels. That is, the red sub-pixels 01*c*, the green sub-pixel 01*b* and the blue sub-pixel 01*a* may be connected to different light-emitting control sub-circuits, respectively, so that light-emitting control signals received by the red sub-pixels 01*c*, the green sub-pixel 01*b* and the blue sub-pixel 01*a* have different duty ratios.

Figure 8:
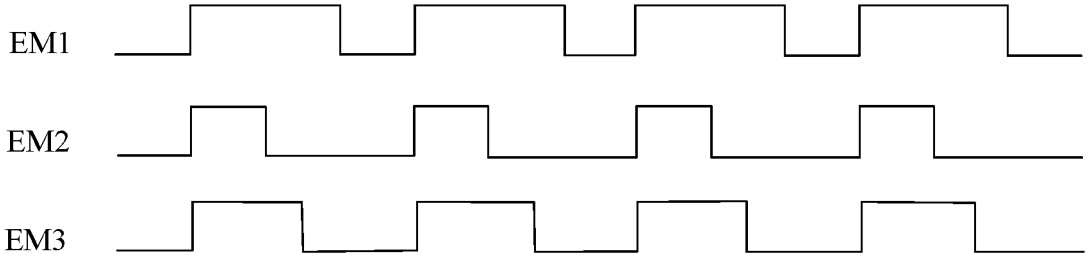
FIG. 8 is a timing diagram of a light-emitting control signal output by a light-emitting control sub-circuit shown in FIG. 7.

Referring to FIG. 8, FIG. 8 shows waveform diagrams of a first light-emitting control signal EM1 sent by the first light-emitting control sub-circuit 0211, a second light-emitting control signal EM2 sent by the second light-emitting control sub-circuit 0212, and a third light-emitting control signal EM3 sent by the third light-emitting control sub-circuit 0213, respectively. As the light-emitting efficiency of the red sub-pixels 01*c* is greater than the light-emitting efficiency of the blue sub-pixel 01*a* and is less than the light-emitting efficiency of the green sub-pixel 01*b*, the duty ratio of the third light-emitting control signal EM3 output by the third light-emitting control sub-circuit 0213 to the red sub-pixels 01*c* is less than the duty ratio of the first light-emitting control signal EM1 output by the first light-emitting control sub-circuit 0211 to the blue sub-pixel 01*a*, and is greater than the duty ratio of the second light-emitting control signal EM2 output by the second light-emitting control sub-circuit 0212 to the green sub-pixel 01*b*. Thus, in the displaying process of one frame of image, the light-emitting time of the light-emitting unit of the red sub-pixels 01*c* is shorter than the light-emitting time of the light-emitting unit of the blue sub-pixel 01*a*, and is longer than the light-emitting time of the light-emitting unit in the green sub-pixel 01*b*.

Exemplarily, the duty ratio of the first light-emitting control signal EM1 output by the first light-emitting control sub-circuit 0211 may be two thirds. The duty ratio of the second light-emitting control signal EM2 output by the second light-emitting control sub-circuit 0212 may be one third. The duty ratio of the third light-emitting control signal EM3 output by the third light-emitting control sub-circuit 0213 may be one half.

It should be noted that, referring to FIGS. 3, 4, 6 and 7, it can be seen that the at least two light-emitting control sub-circuits included in each light-emitting control circuit group may be arranged on the same side of the display panel, or may be arranged on two sides of the display panel, respectively. For example, in the structure shown in FIG. 3, the first light-emitting control sub-circuit 0211 and the second light-emitting control sub-circuit 0212 included in the light-emitting control circuit group 021 are both arranged on the left side of the display panel. In the structure shown in FIGS. 4 and 6, the first light-emitting control sub-circuit 0211 and the second light-emitting control sub-circuit 0212 included in the light-emitting control circuit group 021 are arranged on the left and right sides of the display panel, respectively. In the structure shown in FIG. 7, the first light-emitting control sub-circuit 0211 included in the light-emitting control circuit group 021 is arranged on the left side of the display panel; and the second light-emitting control sub-circuit 0212 and the third light-emitting control sub-circuit are both arranged on the right side of the display panel.

In summary, the embodiments of the present disclosure provide the light-emitting control circuit including the plurality of light-emitting control circuit groups; and each light-emitting control circuit group includes the at least two light-emitting control sub-circuits. The at least two light-emitting control circuits may be connected to the sub-pixels in the same row, and the colors of the sub-pixels connected to any two light-emitting control sub-circuits are different. Thus, the light-emitting times of the light-emitting units in the sub-pixels of different colors in the displaying process of one frame of image can be adjusted by using the different light-emitting control sub-circuits to provide the light-emitting control signals of different duty ratios for the sub-pixels of different colors. Therefore, the magnitudes of the voltages of the data signals provided by the source driver circuit for the sub-pixels of different colors can be appropriately adjusted under the unchanged brightness, prolonging the service life of the light-emitting unit with the lower light-emitting efficiency, and reducing the brightness deviation of the light-emitting unit with the higher light-emitting efficiency caused by the threshold voltage drift. In addition, as the driving current of the light-emitting unit with the higher light-emitting efficiency is increased, the voltage of the data signal output by the source driver circuit to the pixel circuit connected to the light-emitting unit is increased, and it is ensured that the voltage required by the pixel circuit does not exceed the adjustment range of the voltage of the data signal.

Figure 9:
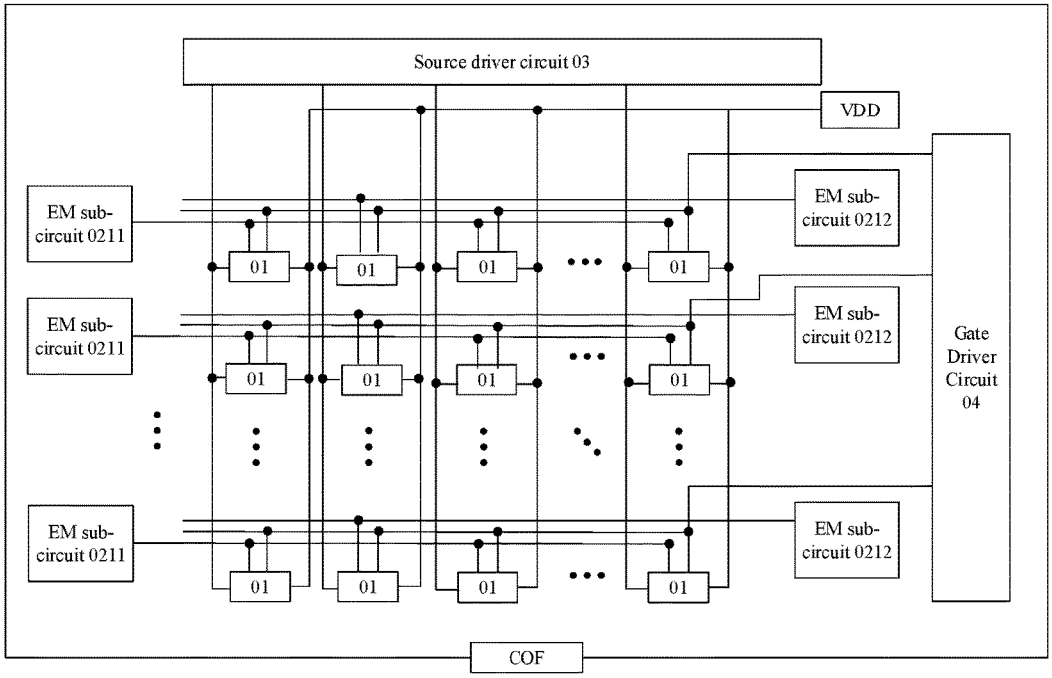
FIG. 9 is a schematic structure diagram of a display panel according to an embodiment of the present disclosure.

FIG. 9 is a schematic structure diagram of a display panel provided by an embodiment of the present disclosure. Referring to FIGS. 1 and 9, it can be seen that the display panel may include: a plurality of sub-pixels 01 arranged in an array, and the light-emitting control circuit shown in any of FIGS. 3, 4, 6, and 7. The light-emitting control circuit may be connected to the light-emitting control signal terminal of the pixel circuit of each sub-pixel 01 in each row of sub-pixels, and may be used to drive a plurality of rows of sub-pixels in the display panel to emit light row by row.

Exemplarily, assuming that the display panel includes N rows×M columns of sub-pixels, the light-emitting control circuit may include N light-emitting control circuit groups.

Referring to FIGS. 1 and 9, it can also be seen that the display panel may further include: a source driver circuit 03. The source driver circuit 03 may be connected to a data signal terminal of a pixel circuit of each sub-pixel 01 in each column of sub-pixels, and is used to provide data signals for the pixel circuits of each column of sub-pixels. The pixel circuit is used for adjusting the magnitude of the driving current output to the light-emitting unit according to the data signal.

In summary, the embodiment of the present disclosure provides the display panel. The display panel may include the plurality of sub-pixels arranged in an array, and the light-emitting control circuit. The light-emitting control circuit may be connected to the light-emitting control signal terminal of the pixel circuit of each sub-pixel in each row of sub-pixels. The light-emitting control circuit can provide the light-emitting control signals of different duty ratios for the sub-pixels of different colors, so that the light-emitting times of the light-emitting units in the sub-pixels of different colors in the displaying process of one frame of image are adjusted. Thus, the magnitudes of the voltages of the data signals provided by the source driver circuit to the sub-pixels of different colors are appropriately adjusted under the unchanged brightness, prolonging the service life of the light-emitting unit with the lower light-emitting efficiency, and reducing the deviation of the brightness of the light-emitting unit with the higher light-emitting efficiency under the influence of the threshold voltage drift. In addition, as the driving current of the light-emitting unit with the higher light-emitting efficiency is increased, the voltage of the data signal output by the source driver circuit to the pixel circuit connected to the light-emitting unit is increased, and it is ensured that the voltage required by the pixel circuit does not exceed the adjustment range of the voltage of the data signal.

Figure 10:
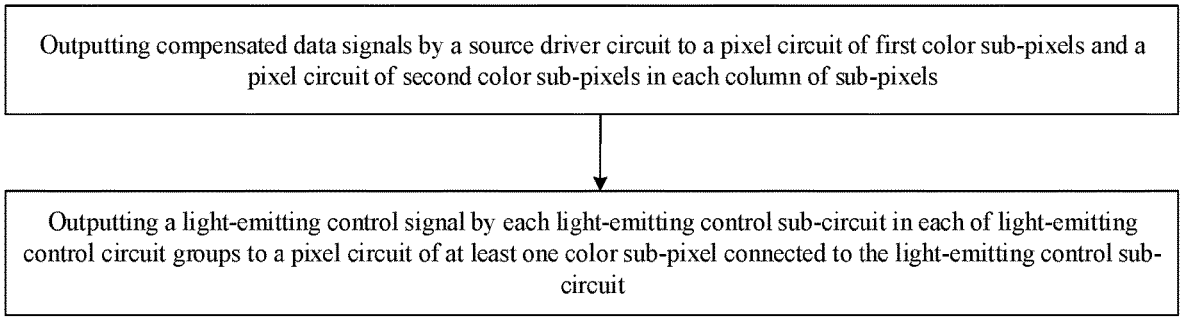
FIG. 10 is a flowchart of a driving method of a display panel according to an embodiment of the present disclosure.

FIG. 10 is a flowchart of a driving method of a display panel provided by an embodiment of the present disclosure. The method can be applied to the display panel shown in FIG. 1 or 9. Referring to FIG. 10, it can be seen that the method may include the following steps.

Compensated data signals are output by a source driver circuit to a pixel circuit of first color sub-pixels and a pixel circuit of second color sub-pixels in each column of sub-pixels; and a light-emitting control signal is output by each light-emitting control sub-circuit in each of light-emitting control circuit groups to a pixel circuit of at least one color sub-pixel connected to the light-emitting control sub-circuit.

In the driving method, the compensated data signals may be used for controlling a magnitude of a driving current output by the pixel circuit in the first color sub-pixels and a magnitude of a driving current output by the pixel circuit in the second color sub-pixels in each column of the sub-pixels; and the magnitude of the driving current is positively related to the magnitude of a voltage of the compensated data signal.

In the embodiment of the present disclosure, the voltage of the compensated data signal output by the source driver circuit to the pixel circuit in the first color sub-pixels are lower than a voltage of a data signal before the compensation; and the voltage of the compensated data signal output by the source driver circuit to the pixel circuit in the second color sub-pixels are higher than a voltage of a data signal before the compensation. The first color sub-pixels may be a sub-pixel with a lower light-emitting efficiency in the light-emitting unit, and the second color sub-pixels may be a sub-pixel with a higher light-emitting efficiency in the light-emitting unit.

Exemplarily, the first color sub-pixels may be a blue sub-pixel; the second color sub-pixels may be a green sub-pixel; the voltage of the data signal before the compensation output by the source driver circuit to the pixel circuit in the blue color sub-pixel is 10V (volts), and the voltage of the compensated data signal may be 8V. The voltage of the data signal before the compensation output by the source driver circuit to the pixel circuit in the green color sub-pixel is 9V (volts), and the voltage of the compensated data signal may be 11V. That is, the driving current of the light-emitting unit in the blue sub-pixel is smaller than a driving current before the compensation. The driving current of the light-emitting unit in the green sub-pixel is larger than the driving current before the compensation.

It should be noted that if the display panel further includes a third color sub-pixel and the third color sub-pixel and the first color sub-pixels are connected to the same light-emitting control sub-circuit, a voltage of a compensated data signal output by the source driver circuit to the pixel circuit in the third color sub-pixel may be lower than the voltage of the data signal before the compensation.

Or, if the display panel further includes a third color sub-pixel and the third color sub-pixel and the second color sub-pixels are connected to the same light-emitting control sub-circuit, a voltage of a compensated data signal output by the source driver circuit to the pixel circuit in the third color sub-pixel may be higher than the voltage of the data signal before the compensation.

Or, if the display panel further includes a third color sub-pixel and the light-emitting control sub-circuit connected to the third-color sub-pixel is different from the light-emitting control sub-circuit connected to the first color sub-pixels and the light-emitting control sub-circuit connected to the second color sub-pixel, the source driver circuit may not need to compensate the data signal of the pixel circuit in the third color sub-pixel. Of course, the source driver circuit may also correspondingly compensate the data signal of the pixel circuit in the third color sub-pixel according to the duty ratio of the light-emitting control signal output by the light-emitting control sub-circuit to the third color sub-pixel.

In the driving method, when a received light-emitting control signal is at an active level, the pixel circuit can drive the light-emitting unit to emit light. Thus, the light-emitting control signal can be used to control a light-emitting time of the light-emitting unit of the sub-pixel in a displaying process of one frame of image.

Referring to FIGS. 3, 4, 6 and 7, it can be seen that the light-emitting control circuit in the display panel may include a plurality of light-emitting control circuit groups. In each light-emitting control circuit group, duty ratios of light-emitting control signals output by any two light-emitting control sub-circuits are different; and the duty ratio of the light-emitting control signal is negatively related to a light-emitting efficiency of the light-emitting unit of the sub-pixel connected to the light-emitting control sub-circuit. That is, the lower the light-emitting efficiency of the light-emitting unit is, the greater the duty ratio of the light-emitting control signal sent by the light-emitting control sub-circuit connected to the sub-pixel including the light-emitting unit is; and the higher the light-emitting efficiency of the light-emitting unit is, the less the duty ratio of the light-emitting control signal sent by the light-emitting control sub-circuit connected to the sub-pixel including the light-emitting unit.

Exemplarily, for the first color sub-pixels with the lower light-emitting efficiency, the duty ratio of the light-emitting control signal output by the light-emitting control sub-circuit to the pixel circuit in the first color sub-pixels are greater than a first threshold. For the second color sub-pixels with the higher light-emitting efficiency, the duty ratio of the light-emitting control signal output by the light-emitting control sub-circuit to the pixel circuit in the second color sub-pixels are less than a second threshold. The first threshold is greater than or equal to the second threshold.

Assuming that the first threshold is three fifths, the duty ratio of the light-emitting control signal output by the light-emitting control sub-circuit to the pixel circuit in the first color sub-pixels may be two thirds. Assuming that the second threshold is two fifths, the duty ratio of the light-emitting control signal output by the light-emitting control sub-circuit to the pixel circuit in the second color sub-pixels may be one third.

Optionally, in the embodiments of the present disclosure, the first color sub-pixels may be the blue sub-pixel, and the second color sub-pixels may be the green sub-pixel. It is assumed that the blue sub-pixel and the red sub-pixels are connected to the first light-emitting sub-circuit and the green sub-pixel is connected to the second light-emitting control sub-circuit. Thus, the duty ratio of the light-emitting control signal output by the first light-emitting control sub-circuit may be larger, and the duty ratio of the light-emitting control signal output by the second light-emitting sub-circuit may be smaller.

The duty ratio of the light-emitting control signal output by the first light-emitting control sub-circuit connected to the blue sub-pixel is greater than the duty ratio of the light-emitting control signal output by the second light-emitting control sub-circuit connected to the green sub-pixel. Thus, in the displaying process of one frame of image, the light-emitting time of the light-emitting unit in the blue sub-pixel is longer than the light-emitting time of the light-emitting unit in the green sub-pixel. For example, in the displaying process of one frame of image, the light-emitting time of the light-emitting unit in the blue sub-pixel may be 24 milliseconds, and the light-emitting time of the light-emitting unit in the green sub-pixel may be 12 milliseconds.

Due to the longer light-emitting time of the light-emitting unit of the blue sub-pixel in the displaying process of one frame of image, when the source driver circuit outputs the compensated data signals to the pixel circuits of the first and second color sub-pixels in each column of the sub-pixels, the voltage of the compensated data signal output by the source driver circuit to the pixel circuit in the blue sub-pixel may be lower than the voltage of the data signal before the compensation, so that the driving current output by the pixel circuit to the light-emitting unit in the blue sub-pixel is reduced, thereby prolonging the service life of the blue sub-pixel.

Due to the shorter light-emitting time of the light-emitting unit of the blue sub-pixel in the displaying process of one frame of image, when the source driver circuit outputs the compensated data signals to the pixel circuits of the first and second color sub-pixels in each column of the sub-pixels, the voltage of the compensated data signal output by the source driver circuit to the pixel circuit in the green sub-pixel may be higher than the voltage of the data signal before the compensation. Thus, an adjustment range of the voltage of the data signal output by the source driver circuit to the pixel circuit in the green sub-pixel can be widened, preventing the voltage output by the source driver circuit to the pixel circuit in the green sub-pixel from exceeding the adjustment range of the voltage of the data signal, and ensuring that the required voltage can be provided for the pixel circuit. In addition, when a lower brightness is displayed, if the voltage of the data signal output by the source driver circuit to the pixel circuit in the green sub-pixel is increased, the driving current output by the pixel circuit to the light-emitting unit in the green sub-pixel will be increased accordingly. Therefore, the threshold voltage drift of the driving transistor in the pixel circuit of the green sub-pixel has a less influence on the driving current, and the brightness deviation of the light-emitting unit in the green sub-pixel can be reduced.

Of course, the above driving method can also be performed in a reverse order. For example, the driving method may include: outputting a light-emitting control signal by each light-emitting control sub-circuit in each of light-emitting control circuit groups to a pixel circuit of at least one color sub-pixel connected to the light-emitting control sub-circuit; and outputting compensated data signals by a source driver circuit to a pixel circuit of first color sub-pixels and a pixel circuit of second color sub-pixels in each column of sub-pixels.

In summary, the embodiments of the present disclosure provide the driving method of the display panel. In the method, the compensated data signals are output by the source driver circuit to the pixel circuit of the first color sub-pixels and the pixel circuit of the second color sub-pixels in each column of the sub-pixels; and the light-emitting control signal is output by each light-emitting control sub-circuit in each of the light-emitting control circuit groups to the pixel circuit of the at least one color sub-pixel connected to the light-emitting control sub-circuit. Thus, the light-emitting control signals of different duty ratios are provided by the different light-emitting control sub-circuits for the sub-pixels of different colors, so that the light-emitting times of the light-emitting units in the sub-pixels of different colors are adjusted in the displaying process of one frame of image. Therefore, the magnitudes of the voltages of the data signals output by the source driver circuit to the sub-pixels of different colors are adjusted under the unchanged brightness, prolonging the service life of the light-emitting unit with the lower light-emitting efficiency, and reducing the brightness deviation of the light-emitting unit with the higher light-emitting efficiency caused by the threshold voltage drift. In addition, as the driving current of the light-emitting unit with the higher light-emitting efficiency is increased, the voltage of the data signal output by the source driver circuit to the pixel circuit connected to the light-emitting unit is increased, and it is ensured that the voltage required by the pixel circuit does not exceed the adjustment range of the voltage of the data signal.

An embodiment of the present disclosure further provides a display device, and the display device may be the display panel shown in FIG. 1 or 9. The display device may be a liquid crystal panel, an electronic paper, an OLED panel, an AMOLED panel, a cell phone, a tablet computer, a TV, a display, a notebook computer, a digital photo frame, a navigator or any other product or member having a display function.

An embodiment of the present disclosure further provides a computer-readable storage medium. Instructions are stored in the computer-readable storage medium. When the computer-readable storage medium runs on a computer, the computer is caused to execute the driving method of the display panel.

Persons of ordinary skill in the art can understand that all or part of the steps described in the above embodiments can be completed through hardware, or through relevant hardware instructed by applications stored in a non-transitory computer readable storage medium, such as a read-only memory, a disk or a CD, etc.

The foregoing descriptions are merely preferred embodiments of the present disclosure, and are not intended to limit the present disclosure. Within the spirit and principles of the disclosure, any modifications, equivalent substitutions, improvements, etc., are within the protection scope of the present disclosure.

What is claimed is:

1. A light-emitting control circuit of a display panel, wherein the display panel comprises a plurality of rows of sub-pixels, each row of sub-pixels in the plurality of rows of sub-pixels comprises at least first color sub-pixels and second color sub-pixels, and each of the first color sub-pixels and the second color sub-pixels comprises a pixel circuit and a light-emitting unit;

the light-emitting control circuit comprises a plurality of light-emitting control circuit groups which are in a one-to-one correspondence with the plurality of rows of sub-pixels, each of the plurality of light-emitting control circuit groups at least comprises a first light-emitting control sub-circuit and a second light-emitting control sub-circuit;

the first light-emitting control sub-circuit is connected to the pixel circuits of the first color sub-pixels, the first light-emitting control sub-circuit is used to provide a first light-emitting control signal, and the first light-emitting control signal is used for driving the pixel circuit to output a driving current to the light-emitting;

the second light-emitting control sub-circuit is connected to the pixel circuits of the second color sub-pixels, the second light-emitting control sub-circuit is used to provide a second light-emitting control signal, the second light-emitting control signal is used for driving the pixel circuit to output a driving current to the light-emitting unit, and the second light-emitting control signal is different from the first light-emitting control signal; and a duty ratio of the first light-emitting control signal output by the first light-emitting control sub-circuit to the pixel circuits of the first color sub-pixels is greater than a first threshold, a duty ratio of the second light-emitting control signal output by the second light-emitting control sub-circuit to the pixel circuits of the second color sub-pixels is less than a second threshold, and the first threshold is greater than or equal to the second threshold.

2. The light-emitting control circuit according to claim 1, wherein the first color sub-pixels are blue sub-pixels, and the second color sub-pixels are green sub-pixels.

3. The light-emitting control circuit according to claim 1, wherein the first light-emitting control signal and the second light-emitting control signal are pulse width modulation PWM signals.

4. The light-emitting control circuit according to claim 3, wherein the duty ratio of the first light-emitting control signal is two thirds; and the duty ratio of the second light-emitting control signal is one third.

5. The light-emitting control circuit according to claim 1, wherein each row of sub-pixels in the plurality of rows of sub-pixels further comprises red sub-pixels; and pixel circuits of the red sub-pixels are connected to the first s light-emitting control sub-circuit or the second light-emitting control sub-circuit.

6. The light-emitting control circuit according to claim 1, wherein each row of sub-pixels in the plurality of rows of sub-pixels further comprises red sub-pixels; each of the plurality of light-emitting control circuit groups further comprises a third light-emitting control sub-circuit, and the red sub-pixels are connected to the third light-emitting control sub-circuit.

7. The light-emitting control circuit according to claim 6, wherein, the first color sub-pixels are blue sub-pixels, and the second color sub-pixels are green sub-pixels; and in a displaying process of one frame of image, a light-emitting time of the light-emitting unit of the red sub-pixels is shorter than a light-emitting time of the light-emitting unit of the blue sub-pixels, and is longer than a light-emitting time of the light-emitting unit of the green sub-pixels.

8. The light-emitting control circuit according to claim 7, wherein, a driving current output by the pixel circuit of the blue sub-pixels to the light-emitting unit of the blue sub-pixels is less than a driving current output by the pixel circuit of the red sub-pixels to the light-emitting unit of the red sub-pixels; and the driving current output by the pixel circuit of the red sub-pixels to the light-emitting unit of the red sub-pixels is less than a driving current output by the pixel circuit of the green sub-pixels to the light-emitting unit of the green sub-pixels.

9. The light-emitting control circuit according to claim 1, wherein, brightness required to be displayed by the light-emitting unit in each sub-pixel is a target brightness, and the driving current output by the pixel circuit to the light-emitting unit is negatively correlated with a light-emitting time of the light-emitting unit in a displaying process of one frame of image.

10. A display device, comprising: a plurality of sub-pixels arranged in an array, and a light-emitting control circuit, wherein each row of sub-pixels comprises at least first color sub-pixels and second color sub-pixels, each of the first color sub-pixels and the second color sub-pixels comprises a pixel circuit and a light-emitting unit, and the light-emitting control circuit is connected to a pixel circuit of each of the plurality of sub-pixels, respectively;

the light-emitting control circuit comprises a plurality of light-emitting control circuit groups which are in a one-to-one correspondence with the plurality of rows of sub-pixels, each of the plurality of light-emitting control circuit groups at least comprises a first light-emitting control sub-circuit and a second light-emitting control sub-circuit;

the first light-emitting control sub-circuit is connected to the pixel circuits of the first color sub-pixels, the first light-emitting control sub-circuit is used to provide a first light-emitting control signal, and the first light-emitting control signal is used for driving the pixel circuit to output a driving current to the light-emitting;

the second light-emitting control sub-circuit is connected to the pixel circuits of the second color sub-pixels, the second light-emitting control sub-circuit is used to provide a second light-emitting control signal, the second light-emitting control signal is used for driving the pixel circuit to output a driving current to the light-emitting unit, and the second light-emitting control signal is different from the first light-emitting control signal; and a duty ratio of the first light-emitting control signal output by the first light-emitting control sub-circuit to the pixel circuits of the first color sub-pixels is greater than a first threshold, a duty ratio of the second light-emitting control signal output by the second light-emitting control sub-circuit to the pixel circuits of the second color sub-pixels is less than a second threshold, and the first threshold is greater than or equal to the second threshold.

11. The display panel according to claim 10, further comprising: a source driver circuit, wherein the source driver circuit is connected to a pixel circuit of each sub-pixel in each column of the plurality of sub-pixels, the source driver circuit is used to provide data signals for pixel circuits in each column of the plurality of sub-pixels; and the pixel circuit is used to adjust a magnitude of a driving current output to the light-emitting unit according to received data signal.

12. The light-emitting control circuit according to claim 10, wherein the first color sub-pixels are blue sub-pixels, and the second color sub-pixels are green sub-pixels.

13. The light-emitting control circuit according to claim 10, wherein the first light-emitting control signal and the second light-emitting control signal are pulse width modulation PWM signals.

14. The light-emitting control circuit according to claim 13, wherein the duty ratio of the first light-emitting control signal is two thirds; and the duty ratio of the second light-emitting control signal is one third.

15. The light-emitting control circuit according to claim 10, wherein each row of sub-pixels in the plurality of rows of sub-pixels further comprises red sub-pixels; and pixel circuits of the red sub-pixels are connected to the first s light-emitting control sub-circuit or the second light-emitting control sub-circuit.

16. The light-emitting control circuit according to claim 10, wherein each row of sub-pixels in the plurality of rows of sub-pixels further comprises red sub-pixels; each of the plurality of light-emitting control circuit groups further comprises a third light-emitting control sub-circuit, and the red sub-pixels are connected to the third light-emitting control sub-circuit.

17. A driving method of a display device, wherein the display device comprises: a plurality of sub-pixels arranged in an array, and a light-emitting control circuit, wherein each row of sub-pixels comprises at least first color sub-pixels and second color sub-pixels, each of the first color sub-pixels and the second color sub-pixels comprises a pixel circuit and a light-emitting unit, and the light-emitting control circuit is connected to a pixel circuit of each of the plurality of sub-pixels, respectively;

the light-emitting control circuit comprises a plurality of light-emitting control circuit groups which are in a one-to-one correspondence with the plurality of rows of sub-pixels, each of the plurality of light-emitting control circuit groups at least comprises a first light-emitting control sub-circuit and a second light-emitting control sub-circuit;

the first light-emitting control sub-circuit is connected to the pixel circuits of the first color sub-pixels, the first light-emitting control sub-circuit is used to provide a first light-emitting control signal, and the first light-emitting control signal is used for driving the pixel circuit to output a driving current to the light-emitting; and the second light-emitting control sub-circuit is connected to the pixel circuits of the second color sub-pixels, the second light-emitting control sub-circuit is used to provide a second light-emitting control signal, the second light-emitting control signal is used for driving the pixel circuit to output a driving current to the light-emitting unit, and the second light-emitting control signal is different from the first light-emitting control signal, and wherein the driving method comprises:

outputting compensated data signals by a source driver circuit to pixel circuits of first color sub-pixels and pixel circuits of second color sub-pixels in each column of the plurality of sub-pixels; and outputting a light-emitting control signal by each light-emitting control sub-circuit in each of light-emitting control circuit groups to pixel circuits of sub-pixels of at least one color connected to the light-emitting control sub-circuit, wherein a duty ratio of the first light-emitting control signal output by the first light-emitting control sub-circuit to the pixel circuits of the first color sub-pixels is greater than a first threshold, a duty ratio of the second light-emitting control signal output by the second light-emitting control sub-circuit to the pixel circuits of the second color sub-pixels is less than a second threshold, and the first threshold is greater than or equal to the second threshold.

18. The driving method according to claim 17, wherein the data signal is used for controlling a magnitude of a driving current output by the pixel circuit; and the light-emitting control signal is used for controlling a light-emitting time of a light-emitting unit in the sub-pixel.

19. The driving method according to claim 17, wherein duty ratios of light-emitting control signals output by any two of the light-emitting control sub-circuits in each of the plurality of light-emitting control circuit groups are different;

and the duty ratio of the light-emitting control signal is negatively related to a light-emitting efficiency of the light-emitting unit.

20. The driving method according to claim 17, wherein the voltage of the compensated data signal output by the source driver circuit to the pixel circuits in the first color sub-pixels are lower than a voltage of a data signal before compensation; and the voltage of the compensated data signal output by the source driver circuit to the pixel circuits in the second color sub-pixels are higher than a voltage of a data signal before compensation.

* * * * *